US011560268B2

(12) United States Patent
Bouteloup et al.

(10) Patent No.: US 11,560,268 B2
(45) Date of Patent: Jan. 24, 2023

(54) DEVICE FOR PACKAGING AT LEAST A FIRST AND A SECOND FLUID

(71) Applicant: CORADIN SAS, Mouans-Sartoux (FR)

(72) Inventors: David Bouteloup, Peymeinade (FR); Fabrice Bourdier, Montauroux (FR); Florence Bidamant, Mulhouse (FR)

(73) Assignee: CORADIN SAS, Mouans-Sartoux (FR)

( * ) Notice: Subject to any disclaimer, the term of this patent is extended or adjusted under 35 U.S.C. 154(b) by 126 days.

(21) Appl. No.: 17/059,907

(22) PCT Filed: Apr. 30, 2019

(86) PCT No.: PCT/FR2019/051004
§ 371 (c)(1),
(2) Date: May 4, 2021

(87) PCT Pub. No.: WO2019/234317
PCT Pub. Date: Dec. 12, 2019

(65) Prior Publication Data

US 2021/0316929 A1 Oct. 14, 2021

(30) Foreign Application Priority Data

Jun. 5, 2018 (FR) ..... 1854861

(51) Int. Cl.
*B65D 81/32* (2006.01)

(52) U.S. Cl.
CPC ..... *B65D 81/3211* (2013.01)

(58) Field of Classification Search
CPC ..... B65D 81/3222; B65D 51/285; B65D 81/3211; B65D 81/3205
(Continued)

(56) References Cited

U.S. PATENT DOCUMENTS 4,103,772 A * 8/1978 Wiegner ..... B65D 81/3211 206/222
4,174,035 A 11/1979 Wiegner
(Continued)

FOREIGN PATENT DOCUMENTS

DE 10 2005 016682 A1 10/2006

OTHER PUBLICATIONS

Written Opinion for Application No. PCT/FR2019/051004 dated Jul. 22, 2019.
(Continued)

*Primary Examiner* — Steven A. Reynolds
(74) *Attorney, Agent, or Firm* — Jenkins, Wilson, Taylor & Hunt, P.A.

(57) ABSTRACT

The invention relates to a device for packaging at least a first and a second fluid comprising an arrangement consisting of a first container for containing a first fluid and a second container for containing a second fluid, wherein the first container is substantially in the form of a tube, preferably in the form of a tube, the first end of which is provided with a dispenser and the second end of which is designed to attach said second container to this second end and thus close said second end of the first container, wherein the second container is substantially in the form of a tube, preferably in the form of a tube, the first end of which is designed to be attached to the second end of the first container, said first end of the second container being closed by means of a tearable wall, and the second end of which is closed by means of a movable wall, said movable wall being designed to be displaced in the direction of said tearable wall to open said tearable wall and thus allow the first and second fluid to mix with each other.

19 Claims, 4 Drawing Sheets

(58) Field of Classification Search
USPC ..... 206/222, 219
See application file for complete search history.

(56) References Cited

U.S. PATENT DOCUMENTS

| | | | | |
|---|---|---|---|---|
| 4,247,001 | A | 1/1981 | Wiegner | |
| 8,550,303 | B2 * | 10/2013 | Greer | B65D 81/3211 222/488 |
| 2003/0052019 | A1 * | 3/2003 | Song | B65D 81/3211 206/219 |
| 2014/0131229 | A1 * | 5/2014 | Tippit | B65D 81/3211 206/219 |
| 2014/0246343 | A1 * | 9/2014 | Sebille | B65D 81/3222 206/222 |
| 2015/0251837 | A1 * | 9/2015 | Krammer | B65D 51/2835 53/474 |
| 2018/0319566 | A1 * | 11/2018 | Pan | B65D 1/0207 |
| 2020/0156851 | A1 * | 5/2020 | Bidamant | B65D 81/3222 |

OTHER PUBLICATIONS

International Search Report for Application No. PCT/FR2019/051004 dated Jul. 10, 2019.

* cited by examiner

DEVICE FOR PACKAGING AT LEAST A FIRST AND A SECOND FLUID

CROSS-REFERENCE TO RELATED APPLICATIONS

This application is a 371 application of PCT/FR2019/051004 filed Apr. 30, 2019, which claims priority to French Patent Application Serial No. 1854861 filed Jun. 5, 2018, the entire disclosures of which are herein incorporated by reference.

TECHNICAL FIELD

The invention relates to a device for packaging at least a first and a second fluid, comprising a first container, making it possible to contain a first fluid and a second container making it possible to contain a second fluid.

The container according to the present invention comprises a first container, designed to receive a first fluid inside said first container. The container is substantially in the form of a tube, preferably in the form of a tube, and is provided, at its first end, with a dispenser. Said dispenser is designed to allow the dispensing of the contents of the first container to the outside.

The device also includes a second container, designed to receive a second fluid. Said second container is substantially in the form of a tube, preferably in the form of a tube.

The device according to the present invention makes it possible to package at least a first fluid and a second fluid inside independent containers by means of a tearable wall. Said device is designed to allow said tearable wall to be torn, at a moment defined by the user, so as to allow mixing of said first and said second fluid which are contained inside the first and the second container of the device.

A container comprising a first and a second container, the inside of which is designed to package fluids separately, has the advantage that each of the two containers can be optimised so as to contain and protect said fluids during the period between the filling of said containers and the use of the fluids by a user.

The device according to the present invention is particularly advantageous in the field of "packaging" intended for cosmetics products. Said device can contain two fluids, in such a way that said two fluids are separate from each other. The first fluid can, for example, be in the form of a liquid, and the second can be a powder. Alternatively, the first and the second fluid can be in the form of two liquids. Other combinations of the two fluids can be envisaged.

BACKGROUND

Nowadays, there are different types of devices that make it possible to package a first and a second fluid separately. As a general rule, these containers are fitted with a striker, which can be used at a moment chosen by the user, making it possible to remove the separator between the two fluids, thus permitting the mixing of the two fluids and obtaining a ready-to-use substance.

The devices known from the prior art propose attaching a striker onto a flexible wall. By virtue of this flexible wall, said striker can be displaced from a first position, where the striker is not in contact with the separator between the two fluids, to a second position where the striker is able to open the separator, thus making it possible for the two fluids to mix.

The presence of a flexible wall within a device can prove useful by allowing said flexible wall to dispense the fluid present inside the device, by modifying the pressure exerted inside said device by means of said flexible wall.

Within the devices described in the paragraphs above, the functionality that makes it possible to open the separator between the two fluids, as well as the functionality that aims to expel said fluids, from the inside of the device to the outside, are combined in the same flexible wall. This means that it is necessary to find a compromise so as, on the one hand, to open the separator correctly and, on the other hand, to allow a user to extract the contents of the device by means of one and the same flexible wall.

SUMMARY

The aim of the present invention consists of proposing an improvement of a device that is intended for packaging a first and a second fluid, in which the functionality that makes it possible to open the separator between the two fluids, as well as the functionality aiming to expel said fluids, are separated.

The subject of the present invention is a device for packaging at least a first and a second fluid comprising an arrangement consisting of a first container for containing a first fluid and a second container for containing a second fluid, wherein the first container is substantially in the form of a tube, preferably in the form of a tube, the first end of which is provided with a dispenser and the second end of which is designed to attach said second container to this second end and thus close said second end of the first container, wherein the second container is substantially in the form of a tube, preferably in the form of a tube, the first end of which is designed to be attached to the second end of the first container, said first end of the second container being closed by means of a tearable wall, and the second end of which is closed by means of a movable wall, said movable wall being designed to be displaced in the direction of said tearable wall to open said tearable wall and thus allow the first and second fluid to mix with each other.

According to an embodiment of the present invention, the movable wall is provided with a striker designed to strike said tearable wall during the movement of said movable wall in the direction of the first end of the second container.

According to an embodiment of the present invention, the movable wall comprises an edge in the form of a flange designed to come into contact with the inner wall of the second container, during the movement of said movable wall in the direction of the first end of the second container, and thus ensure leaktightness between the movable wall and said inner wall of said second container.

According to an embodiment of the present invention, the inner wall of the second container comprises a skirt that makes it possible to create a space between said skirt and the inner wall of the second container, said space being provided with an opening directed, in the assembled position, towards the second end of the second container, said space being designed to receive said flange of the movable wall during the movement of said movable wall in the direction of the first end of the second container.

According to an embodiment of the present invention, the second container comprises at least one opening element, which is substantially positioned parallel to the striker, said at least one opening element being attached to said striker by means of a leg, said at least one opening element being designed to allow the opening of the tearable wall over a larger surface.

According to an embodiment of the present invention, said at least one opening element is designed to limit the movement of the movable wall until said at least one leg is deformed or torn.

According to an embodiment of the present invention, the arrangement, consisting of said first and second containers, is designed to ensure a nested fitting of said second container in the first container.

According to an embodiment of the present invention, the arrangement, consisting of said first and second containers, is designed to ensure a screwed fitting of said second container in the first container.

According to an embodiment of the present invention, at least part of the wall of the first container comprises a flexible material that makes it possible to increase the pressure inside the first container by deforming said part made of flexible material.

BRIEF DESCRIPTION OF THE DRAWINGS

The aims, subjects and characteristics of the invention will become more clearly apparent upon reading the following description with reference to the drawings, in which.

DETAILED DESCRIPTION

Figure 1:
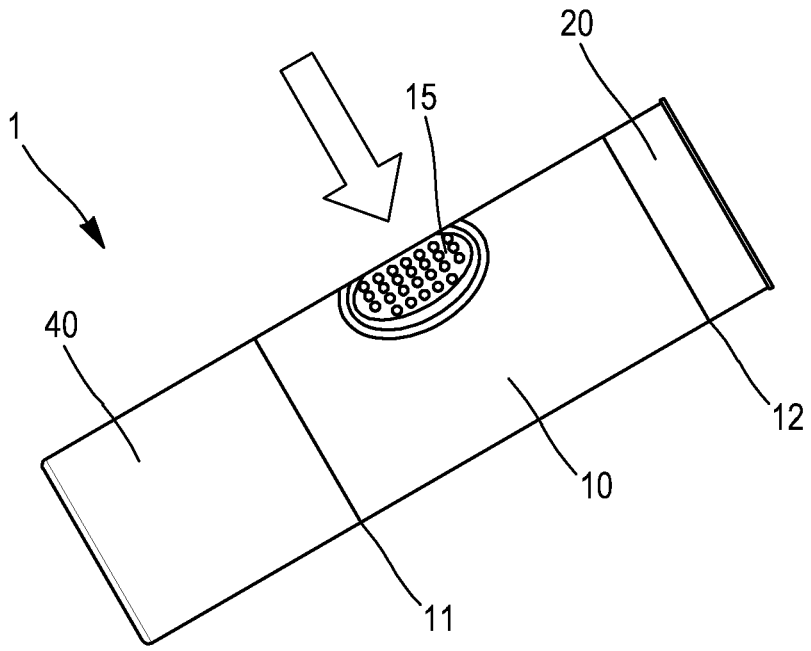
FIG. 1 shows the device according to the present invention, before its use.
Figure 2:
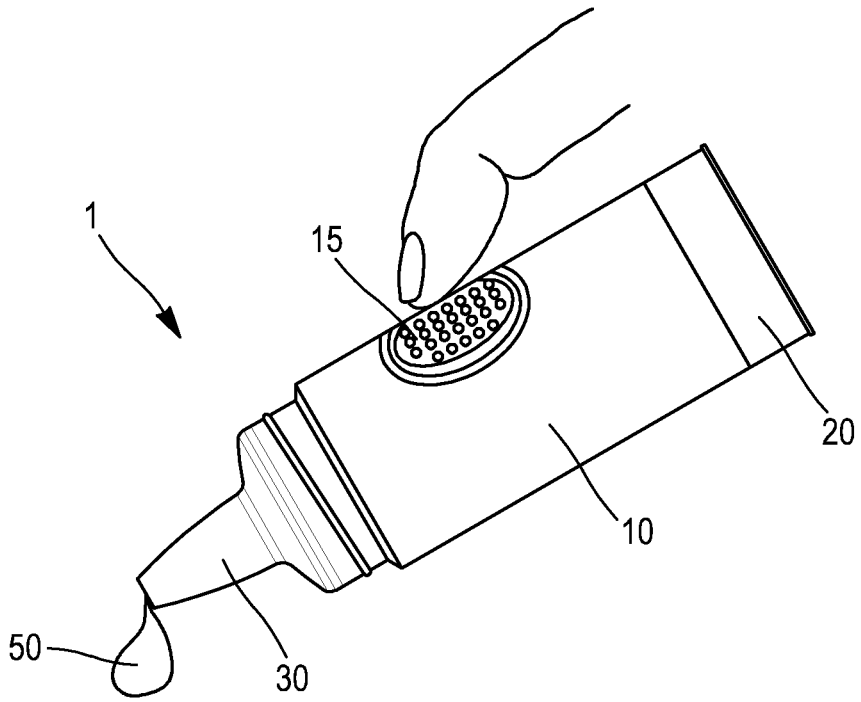
FIG. 2 depicts the device according to the present invention, during its use.

FIG. 1 shows the device 1 according to the invention before its use. The device 1 comprises a first container 10 that makes it possible to contain a first fluid. The first container 10 is substantially in the form of a cylinder provided with a first end 11 to which a dispenser 30 is attached (as shown in FIG. 2), said dispenser 30 being able to be closed by means of a cap 40. The first container 10 comprises a second end 12 to which a second container 20 is attached. Said second container 20 is designed to receive a second fluid. FIG. 1 depicts only part of said second container 20, more details of which can be seen in FIGS. 3, 4, 5 and 6.

As explained with reference to FIG. 4, the device 1 according to the present invention is designed to package a first and a second fluid, separately. The second container 20 is provided with means making it possible to open the separator between the first fluid and the second fluid, at a given moment, in order to thus allow the mixing of the fluids inside the device 1. When the fluids are mixed, the user can remove the cap 40 so as to free the dispenser 30. The mixture of the fluid present inside the device 1 can then be expelled by virtue of a flexible element 15 that forms part of the wall of the first container 10.

As depicted in FIG. 2, the user can, by means of his/her finger, exert pressure on the flexible element 15, thus allowing the expulsion of the contents of the device 1. The expulsion of a given quantity of mixture of the fluid 50 expelled from the device 1 is shown schematically in FIG. 2.

Figure 3:
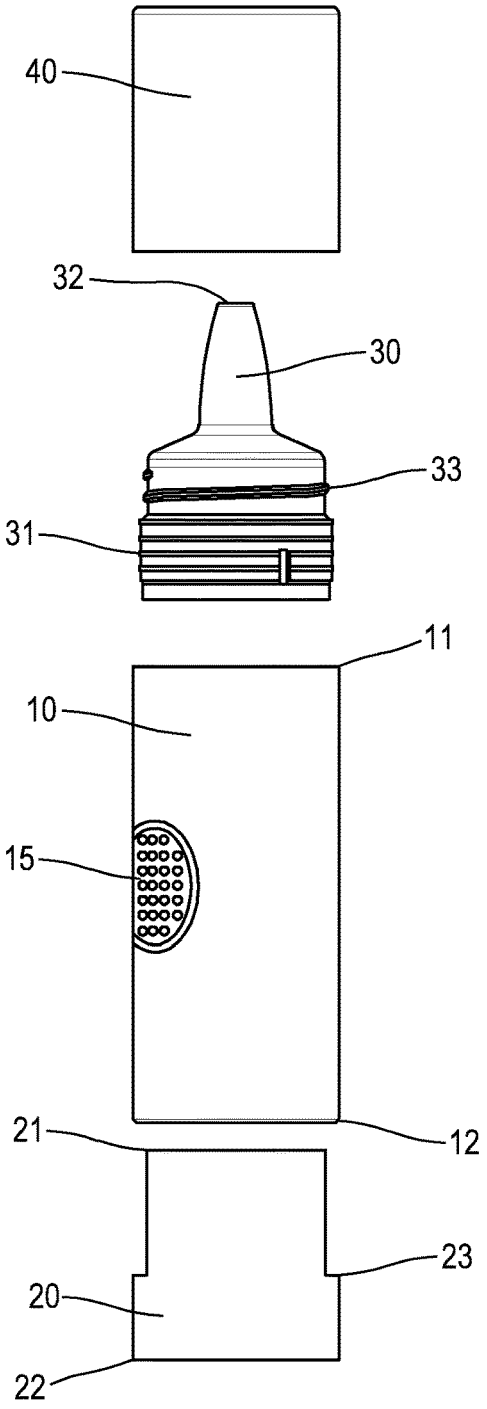
FIG. 3 depicts the different elements that make up the device according to the invention, before their assembly.

FIG. 3 shows the different elements that make up the device 1 according to the present invention, before their assembly. The first container 10 forms the main element of said device 1 according to the invention. A dispenser 30 can be attached to the first end of the first container 10 by means of, for example, a screw thread 31. The second end 12 of the first container 10 is closed by means of the second container 20. Said second container 20 is substantially in the form of a cylinder that extends from a first end 21 towards a second end 22. The circumference of the second container 20 is smaller at the first end 21 than it is at the second end 22 of said second container 20, thus forming a shoulder 23. The first end 21 of the second container 20 is designed to be introduced inside the first container 10 and thus close the second end 12 of the first container 10. The shoulder 23 determines the maximum introduction of the second container 20 inside the first container 10. The dispenser 30 is provided with an outlet 32. Said dispenser 30, and particularly the outlet 32, can be closed up by means of a cap 40, said cap 40 itself being attached to said dispenser by virtue of a screw thread 33.

Figure 4:
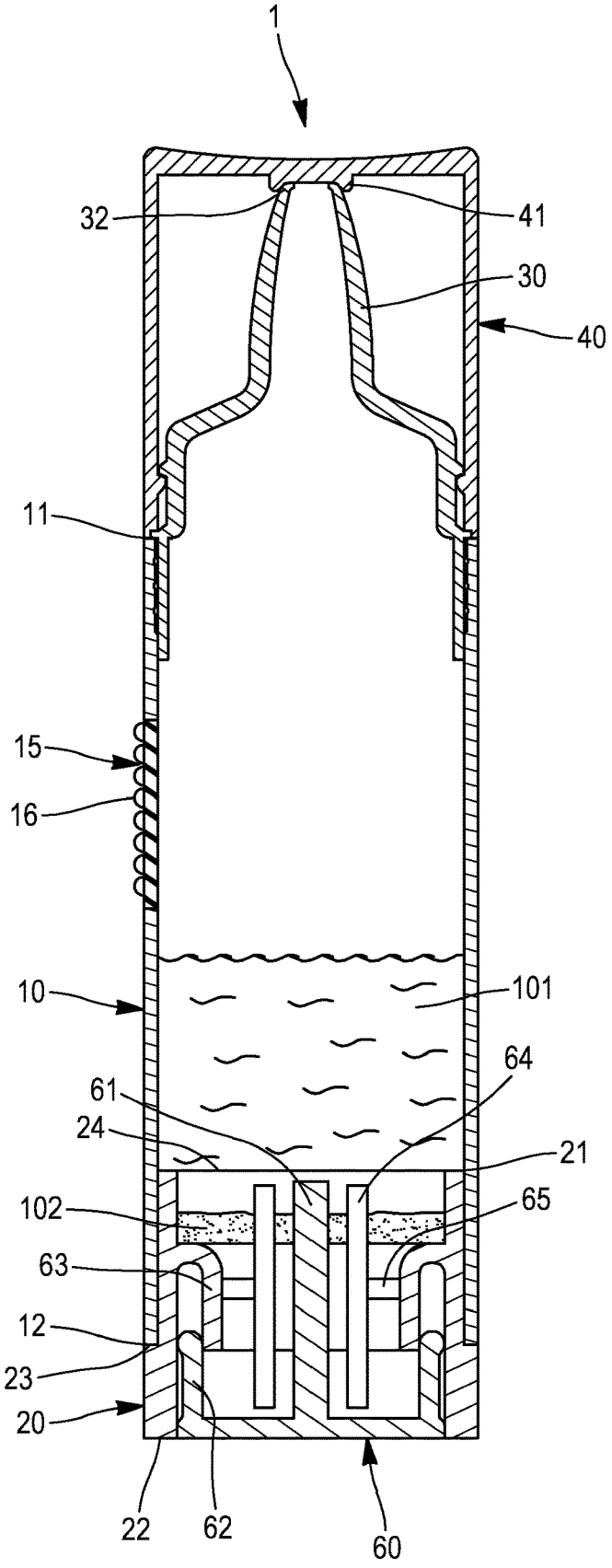
FIG. 4 shows a cross-sectional view of the device according to the present invention.

FIG. 4 depicts a cross-sectional view of the assembly of the device 1 according to the present invention, before its use. FIG. 4 shows that the container 10 comprises, within it, a first fluid 100. FIG. 4 also shows that the first end 11 of the first container 10 is closed up by means of the arrangement formed by the dispenser 30 and the cap 40. The cap 40 comprises an edge 41 that allows the end 31 of the dispenser 30 to be surrounded and closed in an optimal manner.

FIG. 4 shows the presence of the flexible element 15. By exerting pressure on said flexible element 15, the pressure inside the container 10 can be modified so as to thus put pressure on the fluid present inside the first container 10 and allow it to be expelled out of the dispenser 30. The outer surface of the element 15 is provided with small protrusions 16 that make it possible to improve the feel of the user when he/she comes into contact with the element 15. Said protrusions also increase the friction between the finger and the element 15 when the user presses the element 15 towards the inside of the first container 10.

Figure 6:
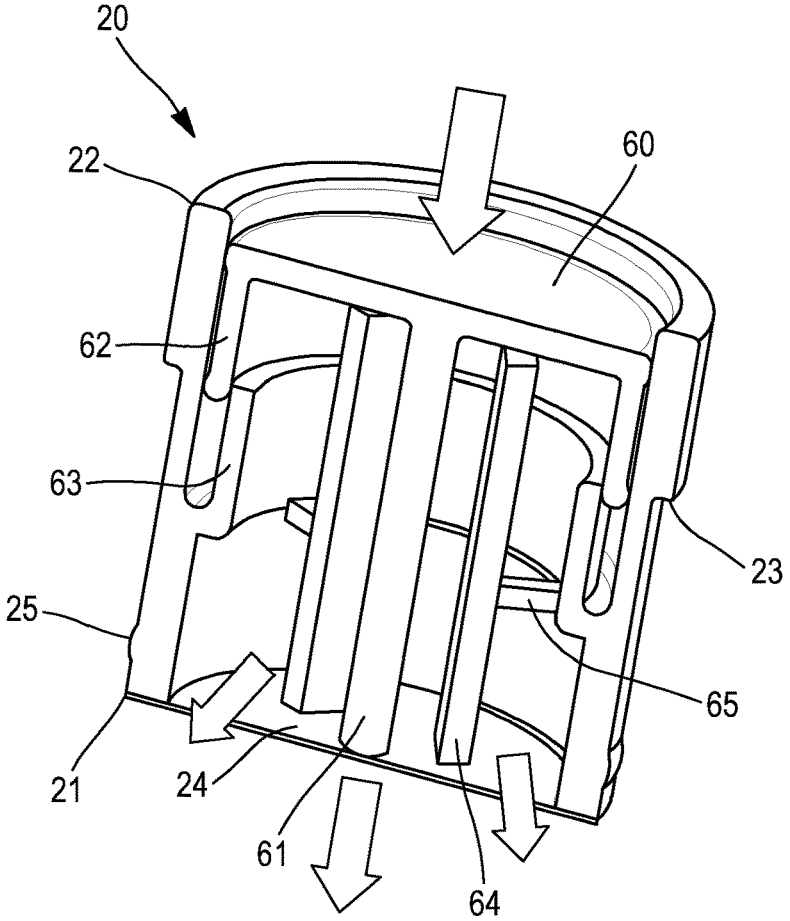
FIG. 6 shows a cross-sectional view of the second container during the movement of the movable wall in the direction of the first end of said second container.

FIG. 4 also shows that the second end 12 of the first container 10 is closed up by means of the second container 20. The second container 20 has been introduced inside the first container 10 up to the shoulder 23 and is in contact with the second end 12 of the first container 10. FIG. 6 depicts, in a detailed manner, the second container 20 as well as its operation.

The second container 20 comprises a first end 21 that is closed by means of a tearable wall 24, said wall 24 being used to separate the second fluid 102, which is present inside the second container 20, from the first fluid 101, which is present inside the first container 10. For the sake of clarity, FIG. 4 depicts only a small part of the second fluid 102. It should be understood that the whole space inside the second container 20 is designed to receive a second fluid 102. Said tearable wall 24 is in the form of a membrane that can consist of any suitable material, for example an aluminium foil. Aluminium is particularly suitable for protecting a product, contained inside the second container 20, from the influence of oxygen or water, for example. The second end 22 of the second container 20 is closed up by means of a movable wall 60, said movable wall 60 being able to be displaced from a position as shown in FIG. 4 in the direction of the first end 21 of the second container 20. The wall 60 is provided with a striker 61. As soon as the wall 60 is displaced in the direction of the first end of the second container 20, the end of said striker 61 can come into contact with and pierce the tearable wall 24, thus making it possible for the first fluid 101 and the second fluid 102 to mix. The movable wall 60 is provided with a flange 62 that has the function of guaranteeing leaktightness between the inner wall of the second container 20 and the movable wall 60, regardless of the position of said movable wall 60.

The inner wall of the second container 20 is provided with a skirt 63, which can be seen more clearly in FIG. 6. A space present between the skirt 63 and the inner wall of the second container 20 is open in the direction of the second end 22 of said second container 20. This space is designed to receive the flange 62 during the movement of the movable wall 60 in the direction of the first end 21 of the second container 20. The presence of said skirt 63 guarantees, on the one hand, leaktightness between the inner wall of the second container 20 and the movable wall 60 and, on the other hand, makes it possible to limit the movement of said movable wall 60 in the direction of the first end 21 of the second container 20.

The second container 20 is provided with several opening elements 64, which are substantially in a longitudinal form and positioned parallel to the striker 61. Said opening elements 64, which are attached to the inside of the skirt 63 by means of legs 65, have a double functionality. First of all, when the movable wall 60 is displaced in the direction of the first end 21 of the second container 20, the opening elements 64 are displaced, together with the striker 61 in the direction of the tearable wall 24. After the tearable wall 24 has been torn by the striker 61, the opening elements 64 make it possible to open said tearable wall 24 over a larger surface. The presence of the opening elements 64 thus makes it possible to guarantee that the tearable wall 24 is sufficiently open so as to allow the first fluid 101 and the second fluid 102 to mix.

The opening elements 64 can, as shown in FIG. 6, function as tamper-proof elements. For this function, the opening elements 64 can guarantee that the wall 60 has not been displaced, unintentionally, in the direction of the first end 21 of the second container 20. As soon as the displacement of the wall 60 takes place in the direction of the first end 21 of the second container 20, said wall 60 comes into contact with the opening elements 64. After this coming into contact, a certain pressure is necessary to deform the legs 65 to which the opening elements 64 are attached inside the skirt 63.

Thus, the opening elements 64 give the user feedback regarding the condition of the tearable wall 24. This feedback can manifest itself in the form of a sensation felt under the fingers when the legs 65 are deformed.

Figure 5:
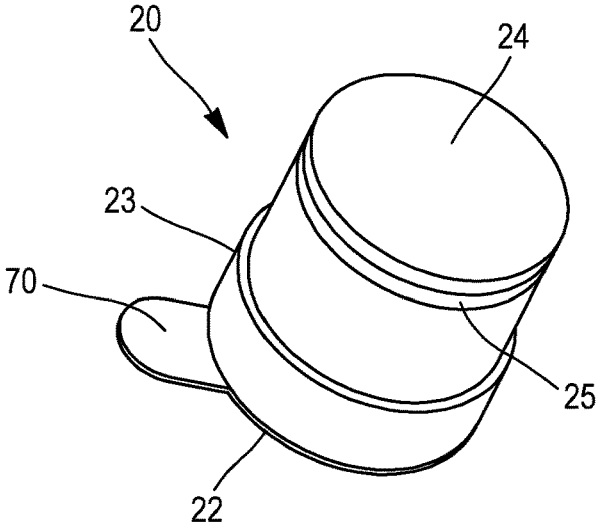
FIG. 5 depicts a perspective view of the second container, designed to receive a second fluid, according to the present invention.

FIGS. 5 and 6 depict a more detailed view of the second container 20 according to the present invention. The second end 22 of the second container 20 is depicted, provided with a protective cap 70 that can protect the second container 20 before its use. In order to have access to the movable wall 60, the user must first of all remove the protective cap 70. The protective cap 70 can be used to protect the contents of the second container 20 and can include information on the use of the device 1. The protective cap 70 can also serve as a "witness" to the first opening of the device 1.

FIGS. 5 and 6 show that the outer wall of the second container, close to the first end 21, is provided with an edge 25. Said edge 25 allows flexible deformation during the introduction of the second container inside the first container to thus ensure leaktight fitting when the first container 10 and the second container 20 are assembled.

FIG. 6 depicts a schematic view of the movable wall 60, during its displacement towards the second end 21 of the second container 20. FIG. 6 shows that, during said displacement, the skirt 63 serves to receive the flange 62 between said skirt 63 and the inner wall of the second container 20. Thus, the leaktightness of the arrangement consisting of the wall of the second container 20 and the wall 60 is guaranteed during the movement of said wall 60, from its first position towards its second position.

FIG. 6 also shows that the opening elements 64, which are attached to the inside of the skirt 63 by means of the legs 65, can be used to open a larger part of the tearable wall 24 once the striker 61 has opened said tearable wall 24.

Figure 7:
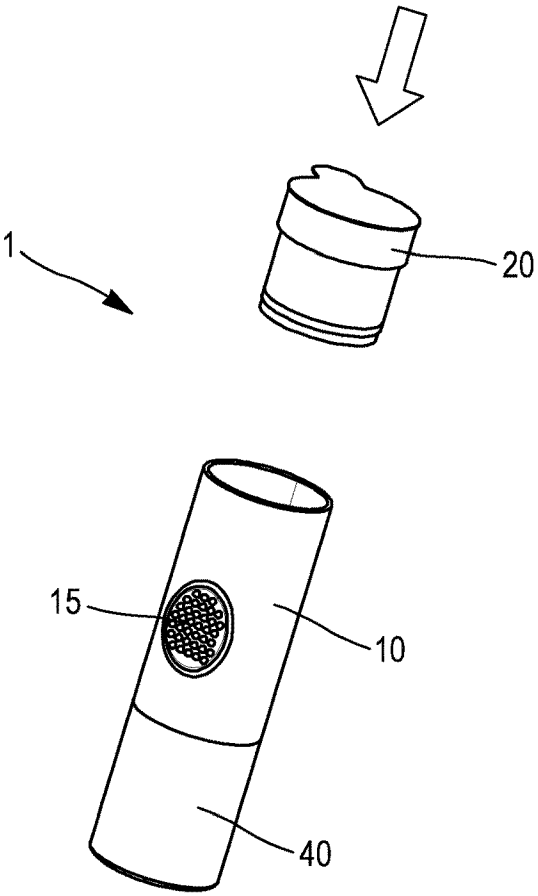
FIG. 7 depicts the assembly of the second container within the second end of the first container, in which said second container is designed to to be fitted irremovably.

FIG. 7 depicts a schematic view of the assembly of the second container 20 inside the first container 10. According to FIG. 7, the second container 20 is designed to be attached, irremovably, to the inside of the first container 10. Thus, it is possible to use the device within which the second fluid that is present inside the second container 20 can be mixed with the first fluid that is present inside the first container 10.

According to an embodiment of the device 1 according to the present invention, the second container 20 can be received and nest inside the second end 12 of the first container 10. In the context of the present description, the term "nested" means that the second end 12 of the second container 20 and the second end 12 of the first container 10 advantageously have the same alignment. In other words, in this embodiment (not shown in the figures), the second container 20 is completely inserted inside the first container 10 so that the user can neither access the outer wall of said second container 20 nor withdraw the latter from inside the first container 10.

Figure 8:
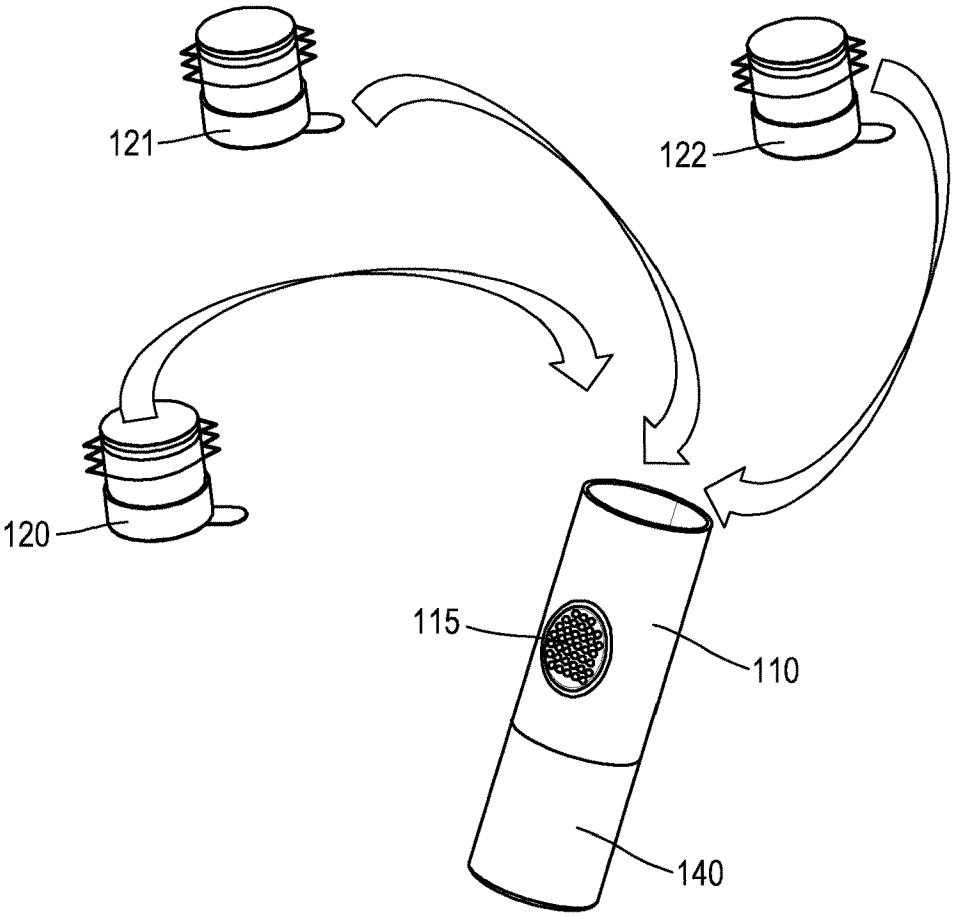
FIG. 8 shows a schematic depiction of the assembly of the first container with, in succession, different containers by means of a removable attachment means, such as a screw thread so as to allow the mixing of several components.

FIG. 8 shows an alternative embodiment of the device in which, in a sequential manner, a second container 120 can be introduced inside the first container 110. The second end of said first container 110 and of the second container 120 are each provided with a screw thread that makes it possible to attach the second container 120 to the inside of the first container 110, said attachment being removable. According to the example depicted in FIG. 8, after the attachment and use of the second container 120, another second container 121 can be attached to the second end of the first container 110. After use, this second container 121 can be removed thus allowing the attachment of a new second container 122 to the inside of the first container 110. According to the example depicted in FIG. 8, the second containers 120, 121, 122 can each contain a different fluid. Their use, one after the other, allows the mixing of several fluids inside the device according to the present invention.

The invention claimed is:

1. A device for packaging at least a first fluid and a second fluid, the device comprising:

an arrangement consisting of:

a first container that is substantially in a form of a tube for containing the first fluid therein; and a second container that is substantially in a form of a tube for containing the second fluid therein;

wherein, for the first container, a first end thereof comprises a dispenser and a second end thereof is designed to attach to the second container to close the second end of the first container;

wherein, for the second container, a first end thereof is designed to attach to the second end of the first container and a second end thereof is closed by a movable wall;

wherein the first end of the second container is closed by a tearable wall;

wherein the movable wall is designed to move in a direction of the tearable wall to open the tearable wall and to thus allow the first fluid and the second fluid to mix with each other; and wherein the movable wall comprises an edge, which is in a form of a flange and is designed to come into contact with an inner wall of the second container during movement of the movable wall in the direction of the tearable wall to form a leaktight seal between the movable wall and the inner wall of the second container.

2. The device according to claim 1, wherein the movable wall comprises a striker designed to strike the tearable wall during the movement of the movable wall in the direction of the tearable wall.

3. The device according to claim 1, wherein:

the inner wall of the second container comprises a skirt that is formed such that there is a space between the skirt and the inner wall of the first container;

the space has an opening directed in an assembly position towards the second end of the second container; and the space is designed to receive the flange of the movable wall therein during the movement of the movable wall in the direction of the tearable wall.

4. The device according to claim 2, wherein:

the second container comprises at least one opening element, which is positioned substantially parallel to the striker;

the at least one opening element is attached to the striker by at least one leg; and the at least one opening element is designed to allow the tearable wall to be opened over a larger surface than that of the striker.

5. The device according to claim 4, wherein the at least one opening element is designed to limit the movement of the movable wall until the at least one leg is deformed or torn.

6. The device according to claim 1, wherein the second container is nested within the first container.

7. The device according to claim 1, wherein the second container is attached to the first container by a screwed fitting.

8. The device according to claim 1, wherein at least a part of a wall of the first container comprises a flexible material, such that a pressure inside the first container can be increased by deforming the part of the wall of the first container that is made of the flexible material.

9. The device according to claim 1, wherein the first container is in a form of a tube.

10. The device according to claim 1, wherein the second container is in a form of a tube.

11. The device according to claim 1, wherein the first container is in a form of a tube and the second container is in a form of a tube.

12. A device for packaging at least a first fluid and a second fluid, the device comprising:

an arrangement consisting of:

a first container that is substantially in a form of a tube for containing the first fluid therein; and a second container that is substantially in a form of a tube for containing the second fluid therein;

wherein, for the first container, a first end thereof comprises a dispenser and a second end thereof is designed to attach to the second container to close the second end of the first container;

wherein, for the second container, a first end thereof is designed to attach to the second end of the first container and a second end thereof is closed by a movable wall;

wherein the first end of the second container is closed by a tearable wall;

wherein the movable wall is designed to move in a direction of the tearable wall to open the tearable wall and to thus allow the first fluid and the second fluid to mix with each other;

wherein the movable wall comprises a striker designed to strike the tearable wall during the movement of the movable wall in the direction of the tearable wall;

wherein the second container comprises at least one opening element, which is positioned substantially parallel to the striker;

wherein the at least one opening element is attached to the striker by at least one leg; and wherein the at least one opening element is designed to limit the movement of the movable wall until the at least one leg is deformed or torn.

13. The device according to claim 12, wherein:

the movable wall comprises an edge, which is in a form of a flange and is designed to come into contact with an inner wall of the second container during movement of the movable wall in the direction of the tearable wall to form a leaktight seal between the movable wall and the inner wall of the second container;

the inner wall of the second container comprises a skirt that is formed such that there is a space between the skirt and the inner wall of the first container;

the space has an opening directed in an assembly position towards the second end of the second container; and the space is designed to receive the flange of the movable wall therein during the movement of the movable wall in the direction of the tearable wall.

14. The device according to claim 12, wherein the second container is nested within the first container.

15. The device according to claim 12, wherein the second container is attached to the first container by a screwed fitting.

16. The device according to claim 12, wherein at least a part of a wall of the first container comprises a flexible material, such that a pressure inside the first container can be increased by deforming the part of the wall of the first container that is made of the flexible material.

17. The device according to claim 12, wherein the first container is in a form of a tube.

18. The device according to claim 12, wherein the second container is in a form of a tube.

19. The device according to claim 12, wherein the first container is in a form of a tube and the second container is in a form of a tube.

* * * * *